US012325893B2

(12) United States Patent
Jacqueson et al.

(10) Patent No.: US 12,325,893 B2
(45) Date of Patent: Jun. 10, 2025

(54) METHOD FOR MANUFACTURING A STEEL SHEET WITH A ZnAlMg COATING, CORRESPONDING COATED STEEL SHEET, PART AND VEHICLE

(71) Applicant: ArcelorMittal, Luxembourg (LU)

(72) Inventors: Eric Jacqueson, Longeville-les-Metz (FR); Jean-Michel Mataigne, Senlis (FR); Larissa Agrizzi Ronqueti, Metz (FR); Marine Kieffer, Boulay (FR)

(73) Assignee: ArcelorMittal, Luxembourg (LU)

( * ) Notice: Subject to any disclaimer, the term of this patent is extended or adjusted under 35 U.S.C. 154(b) by 26 days.

(21) Appl. No.: 18/036,352

(22) PCT Filed: Nov. 15, 2021

(86) PCT No.: PCT/IB2021/060553
§ 371 (c)(1),
(2) Date: May 10, 2023

(87) PCT Pub. No.: WO2022/101872
PCT Pub. Date: May 19, 2022

(65) Prior Publication Data

US 2023/0399713 A1 Dec. 14, 2023

(30) Foreign Application Priority Data

Nov. 16, 2020 (WO) ..... PCT/IB2020/060737

(51) Int. Cl.
*C21D 9/46* (2006.01)
*C21D 8/02* (2006.01)
(Continued)

(52) U.S. Cl.
CPC ..... *C21D 9/46* (2013.01); *C21D 8/0236* (2013.01); *C21D 8/0273* (2013.01); *C23C 2/06* (2013.01); *C23C 2/20* (2013.01); *C23C 2/40* (2013.01)

(58) Field of Classification Search
CPC ..... C21D 9/46; C21D 8/0236; C21D 8/0273; C23C 2/06
See application file for complete search history.

(56) References Cited

U.S. PATENT DOCUMENTS

2011/0111255 A1 5/2011 Diez et al.
2012/0107636 A1 5/2012 Diez et al.
(Continued)

FOREIGN PATENT DOCUMENTS

CA 3033685 A1 3/2018
EP 3733921 A1 11/2020
(Continued)

OTHER PUBLICATIONS

Search Report of PCT/IB2021/060553 of Dec. 22, 2021 and International Report on Patentability.

*Primary Examiner* — Nathan T Leong
(74) *Attorney, Agent, or Firm* — Davidson Kappel LLC

(57) ABSTRACT

A method for manufacturing a steel sheet provided with a coating included from 0.80 to 1.40 wt. % of Al, from 0.80 to 1.40 wt. % of Mg, unavoidable impurities and optionally one or more additional elements selected from Si, Sb, Pb, Ti, Ca, Mn, Sn, La, Ce, Cr, Zr or Bi, the weight content of each additional element in the coating being less than 0.3%, the remainder being Zn, the outer surface of the coated steel sheet having a waviness $Wa_{0.8}$ before skin-pass of less than or equal to 0.50 μm; the coated steel sheet obtained by this
(Continued)

method; the part obtained by deformation of a steel sheet and a land motor vehicle comprising a body, the body including the part.

5 Claims, 2 Drawing Sheets

(51) Int. Cl.

| | |
|---|---|
| ***C23C 2/06*** | (2006.01) |
| ***C23C 2/20*** | (2006.01) |
| ***C23C 2/40*** | (2006.01) |

(56) References Cited

U.S. PATENT DOCUMENTS

| | | | | |
|---|---|---|---|---|
| 2015/0292072 | A1 | 10/2015 | Mataigne | |
| 2017/0029928 | A1* | 2/2017 | Mataigne | C23C 2/20 |
| 2018/0080111 | A1 | 3/2018 | Mataigne et al. | |
| 2020/0087761 | A1 | 3/2020 | Aarnts et al. | |

FOREIGN PATENT DOCUMENTS

| | | | |
|---|---|---|---|
| JP | 2019534949 | A | 12/2019 |
| WO | WO 2009/147309 | A1 | 5/2008 |
| WO | WO2010130883 | A1 | 11/2010 |
| WO | WO 2014/135999 | A1 | 9/2014 |
| WO | WO2015092493 | A1 | 6/2015 |
| WO | WO2018073115 | A1 | 4/2018 |
| WO | WO2020048772 | | 3/2020 |

* cited by examiner

METHOD FOR MANUFACTURING A STEEL SHEET WITH A ZnAlMg COATING, CORRESPONDING COATED STEEL SHEET, PART AND VEHICLE

The present invention relates to a method for manufacturing a steel sheet provided with a coating comprising from 0.80 to 1.40 wt. % of Al, from 0.80 to 1.40 wt. % of Mg, unavoidable impurities and optionally one or more additional elements selected from Si, Sb, Pb, Ti, Ca, Mn, Sn, La, Ce, Cr, Zr or Bi, the weight content of each additional element in the coating being less than 0.3%, the remainder being Zn and the coated steel sheet obtained by this method. Such a steel sheet is more particularly intended for making body parts for a land motor driven vehicle such as an automobile.

BACKGROUND

Usually, the steel sheet is cut out and deformed to form the body parts or the body. This body is then coated with a film of paint (or paint system) which ensures a good aspect of the surface and participates with the coating based on zinc, in protection against corrosion.

Coatings based on zinc of steel sheets have what is called a waviness of their outer surfaces, which can presently only be compensated by significant thicknesses of paint, under the penalty of having a so-called "orange peel" aspect, unacceptable for body parts.

The waviness W of the outer surface of a coating is a smooth pseudo-periodic geometrical irregularity with quite long wavelength (0.8 to 10 mm) which is distinguished from roughness R which corresponds to geometrical irregularities with short wavelengths.

The arithmetic mean Wa of the waviness profile, expressed in μm, is often used for characterizing the waviness of the outer surface of a steel sheet coating, and the waviness is measured with 0.8 mm a cut-off threshold and designated by $Wa_{0.8}$ according to the standard SEP1941.

A reduction in the waviness $Wa_{0.8}$ may allow reduction of the thickness of the paint film used for attaining a given property of paint aspect or, for constant thickness of the paint film, an improvement in the quality of the paint aspect.

Some methods to reduce the waviness of zinc coated steel sheets are known.

Indeed, the patent application publication WO 2014/135999 discloses a method for manufacturing a steel sheet provided with a zinc coating comprising 0.2 to 0.7% of aluminium, comprising the steps of providing the steel sheet, depositing a coating on at least one face of the steel sheet by dipping the steel sheet in a bath, wiping the coating with a wiping gas from at least one nozzle projecting through at least one outlet, the steel sheet running in front of the at least one nozzle, the wiping gas being ejected from the nozzle along a main ejection direction E, an outer surface of the coating having, after solidification and before any skin-pass operation, a waviness $Wa_{0.8}$ of less than or equal to 0.55 μm; and satisfying at least one of the following equations:

$$\frac{Z}{d} + 18\ln\left(\frac{Z}{D}\right) < 8\ln\left(\frac{P}{V}\right) - 27.52 \quad \text{(A)}$$

$$fO_2 < \frac{2{,}304.10^{-3}}{\left(27.52 + \frac{Z}{d} + 8\ln\left(\frac{V}{P}\left(\frac{Z}{d}\right)^{2.25}\right)\right)^2} \quad \text{(B)}$$

wherein:

Z is a distance between the steel sheet and the nozzle along the main ejection direction E, Z being expressed in mm, d is an average height of the outlet of the at least one nozzle along a running direction S of the steel sheet in front of the nozzle, d being expressed in mm, V is a running speed of the steel sheet in front of the at least one nozzle, V being expressed in $m \cdot s^{-1}$, P is a pressure of the wiping gas in the at least one nozzle, P being expressed in $N \cdot m^{-2}$, and $fO_2$ is a volume fraction of oxygen in the wiping gas.

This patent application also discloses the obtained steel sheet coated, the outer surface of the coating having a waviness $Wa_{0.8}$, before an optional skin-pass operation, of less than or equal to 0.35 μm. Finally, the patent discloses a part obtained by deformation of said steel sheet wherein the outer surface of the coating has a waviness $Wa_{0.8}$ of less than or equal to 0.43 μm.

SUMMARY OF THE INVENTION

However, this method is only suitable for controlling the waviness of coatings comprising zinc and a small amount of aluminum. Indeed, depending on the nature of the coating, it is known that the waviness of the outer surface of the coating can significantly change.

Recently, new coatings based on zinc have been developed. These coatings usually called "ZnAlMg coatings" comprise aluminum, magnesium, the balance being zinc. They are used to further improve the corrosion resistance of steel sheets.

The patent application publication WO 2009/147309 discloses a process for manufacturing a steel strip having a corrosion protection coating, comprising passing the steel strip through a bath of molten steel comprising between 2 and 8 wt % aluminum, 0 to 5 wt % magnesium and up to 0.3 wt % addition elements, with a balance being zinc and unavoidable impurities, and said bath being maintained at a temperature between 35° and 700° C., to obtain a coated steel strip; then wiping the coated steel strip with nozzles spraying a gas on either side of the strip; and then cooling the coating in a controlled manner until it has completely solidified, said cooling being carried out at a rate less than 15° C./s between a temperature on leaving a unit where the wiping occurs and a start of solidification and then at a rate greater than or equal to 15° C./s between the start and end of its solidification.

This patent also discloses a cold-rolled steel strip, hot-dip coated but not skin-passed wherein the coating of which comprises 2 to 8 wt % aluminum, 0 to 5 wt % magnesium and up to 0.3 wt % additional elements, a balance consisting of zinc and unavoidable impurities, said coating having a waviness $Wa_{0.8}$ of 0.5 μm or less.

Finally, this patent application discloses a steel part obtained by deformation wherein the coating of which has a waviness $Wa_{0.8}$ of 0.48 μm or less and a steel part obtained by deformation having furthermore undergone a skin-pass operation before deformation, the coating of which has a waviness $Wa_{0.8}$ of 0.35 μm or less.

However, in this application, the ZnAlMg coating comprises a high amount of Aluminum. As showed in Examples, when the amount of Aluminum is lower than 2%, the waviness levelling effect is not obtained by applying such method.

The aim of the invention is therefore to provide a method for making a ZnAlMg coated steel sheet having a low amount of Al and Mg, the outer surface of the coating having a reduced waviness $Wa_{0.8}$.

The present invention provides a method for manufacturing a steel sheet provided with a coating comprising from 0.80 to 1.40 wt. % of Al, from 0.80 to 1.40 wt. % of Mg, unavoidable impurities and optionally one or more additional elements selected from Si, Sb, Pb, Ti, Ca, Mn, Sn, La, Ce, Cr, Zr or Bi, the weight content of each additional element in the coating being less than 0.3%, the remainder being Zn, the method comprising the following successive steps:

A. providing the steel sheet,

B. cold rolling the steel sheet, at least the last rolling pass being achieved with rectified and non-etched work rolls for which the work surfaces have a roughness $Ra_{2.5}$ of less than or equal to 0.5 μm, C. annealing of the steel sheet in a continuous annealing line, D. depositing said coating by dipping said steel sheet in a molten bath, E. running the coated steel sheet through a confinement zone including wiping nozzles projecting a wiping gas, through at least one outlet, on each side of the sheet along a main ejection direction (E), said wiping satisfying at least one of the following equations:

$$\sqrt{\frac{V}{P}} \times \left(\frac{Z}{d}\right)^2 \leq 0.6566 \quad (1)$$

$$p_{O_2} \leq \left[\frac{200 \times \frac{V}{P}}{\ln\left[1.523 \times \sqrt{\frac{V}{P}} \times \left(\frac{Z}{d}\right)^2\right]}\right]^2 \quad (2)$$

wherein:

V is the running speed of the steel sheet in front of the nozzle, V being expressed in $m \cdot s^{-1}$, P is the pressure of the wiping gas in the nozzle, P being expressed in Pa Z is the distance between the steel sheet and the nozzle along the main ejection direction (E), Z being expressed in mm, d is the average height of the outlet of the nozzle along the running direction(S) of the steel sheet in front of the nozzle, d being expressed in mm, $p_{O2}$ is the partial pressure in oxygen in the confinement zone, F. solidifying the coating, and G. skin-passing said coated steel sheet with work rolls having a roughness $Ra_{2.5}$ below 5 μm.

BRIEF DESCRIPTION OF THE DRAWINGS

The invention will be illustrated by examples given as an indication, and not as a limitation, and with reference to the appended figures wherein.

DETAILED DESCRIPTION

Figure 1:
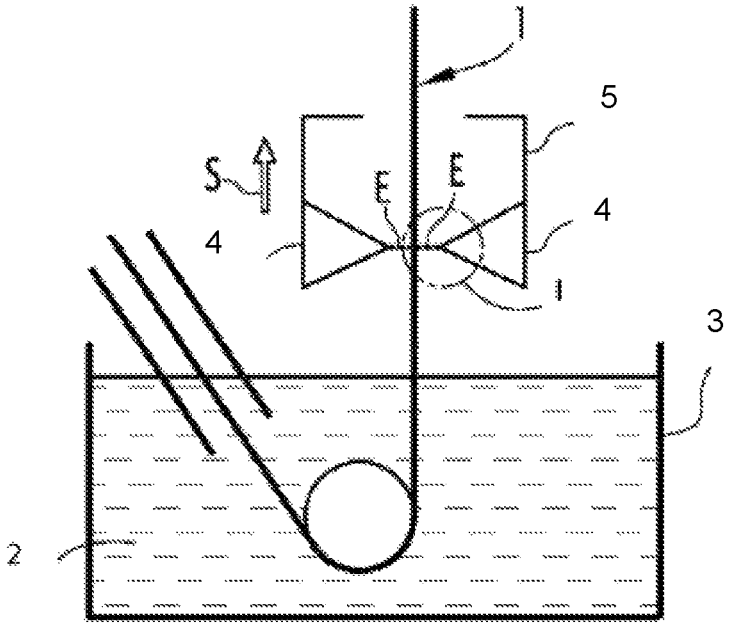
FIG. 1 is a schematic side view illustrating the method according to the present invention and FIG. 2 is a partial, schematic and enlarged view of the circled portion I of FIG. 1.

The present invention provides a method for manufacturing a coated steel sheet comprising a steel sheet coated with a coating comprising from 0.80 to 1.40 wt. % of Al, from 0.80 to 1.40 wt. % of Mg, unavoidable impurities and optionally one or more additional elements selected from Si, Sb, Pb, Ti, Ca, Mn, Sn, La, Ce, Cr, Zr or Bi, the weight content of each additional element in the coating being less than 0.3%, the remainder being Zn, the method comprising the following successive steps:

A. providing the steel sheet,

B. cold rolling the steel sheet, at least the last pass being achieved with rectified and non-etched work rolls for which the work surfaces have a roughness $Ra_{2.5}$ of less than or equal to 0.5 μm, C. annealing of the steel sheet in a continuous annealing line, D. depositing said coating by dipping said steel sheet in a molten steel bath, E. running the coated steel sheet through a confinement zone including wiping nozzles projecting a wiping gas, through at least one outlet, on each side of the sheet along a main ejection direction (E), said wiping satisfying at least one of the following equations:

$$\sqrt{\frac{V}{P}} \times \left(\frac{Z}{d}\right)^2 \leq 0.6566 \quad (1)$$

$$p_{O_2} \leq \left[\frac{200 \times \frac{V}{P}}{\ln\left[1.523 \times \sqrt{\frac{V}{P}} \times \left(\frac{Z}{d}\right)^2\right]}\right]^2 \quad (2)$$

wherein:

V is the running speed of the steel sheet in front of the nozzle, V being expressed in $m \cdot s^{-1}$, P is the pressure of the wiping gas in the nozzle, P being expressed in Pa Z is the distance between the steel sheet and the nozzle along the main ejection direction (E), Z being expressed in mm, d is the average height of the outlet of the nozzle along the running direction(S) of the steel sheet in front of the nozzle, d being expressed in mm, $p_{O2}$ is the partial pressure in oxygen in the confinement zone, F. solidifying the coating.

Without willing to be bound by any theory, it is believed that the method according to the present invention allows for a steel sheet provided with a coating comprising from 0.80 to 1.40 wt. % of Al, from 0.80 to 1.40 wt. % of Mg, the remainder being Zn to get an outer surface with a waviness $Wa_{0.8}$ low enough to lead to a highly improved surface aspect and especially painted aspect. Indeed, it seems that for these ZnAlMg coated steel sheets, conventional methods of the prior art do not lead to such low waviness. The inventors have found that not only the chemical elements of the coating and the amounts of elements in this coating, but also the method applied have an impact on the waviness. To obtain the lowest waviness possible for the ZnAlMg coated steel sheets having the above specific amounts of Al and Mg, it seems that the method according to the present invention is needed to control the surface of the above ZnAlMg coatings and obtain waviness values never reached in the prior art.

In a preferred embodiment, the wiping step of the method according to the invention is such that at least one of the following equations is further satisfied:

$$\sqrt{\frac{V}{P}} \times \left(\frac{Z}{d}\right)^2 \leq 0.4887 \quad (3)$$

$$p_{O_2} \leq \left[\frac{200 * \frac{V}{P}}{\ln\left[2.046 \times \sqrt{\frac{V}{P}} \times \left(\frac{Z}{d}\right)^2\right]}\right]^2 \quad (4)$$

wherein:

V is the running speed of the steel sheet in front of the nozzle, V being expressed in $m \cdot s^{-1}$, P is the pressure of the wiping gas in the nozzle, P being expressed in Pa Z is the distance between the steel sheet and the nozzle along the main ejection direction (E), Z being expressed in mm, d is the average height of the outlet of the nozzle along the running direction(S) of the steel sheet in front of the nozzle, d being expressed in mm, $p_{O2}$ is the partial pressure in oxygen in the confinement zone.

It has been observed that satisfying at least one of the equations (3) or (4), in addition to satisfying at least one of the equations (1) or (2) allows reducing further the waviness of the coated steel sheet.

The steel sheet 1 of FIG. 1 comprises a steel sheet coated on each of its two faces with the above ZnAlMg coating. Preferably, the steel sheet is a low carbon steel, for example Interstitial Free steel (IF-steel), a Bake-Hardenable steel or an Al killed steel.

The coating generally has a thickness of less than or equal to 25 μm and aims at protecting the steel sheet 1 against corrosion.

For making the steel sheet 1, it is possible for example to proceed as follows.

A sheet such as a steel sheet obtained for example by hot and then cold-rolling is used.

Preferably, for cold-rolling, one starts by cold-rolling the sheet with a reduction rate generally comprised between 30 and 85%, to obtain a sheet 1 with a thickness for example comprised between 0.2 and 2 mm. It is needed to ensure that at least the last cold-rolling pass is carried out with so-called smooth or bright work rolls, i.e. rectified and non-etched rolls, for which the work surfaces have a roughness $Ra_{2.5}$, i.e. measured with a cut-off threshold at 2.5 mm, less than or equal to 0.5 μm.

It is recalled that work rolls are the rolls of the rolling mill directly in contact with the sheet 1 for ensuring its deformation. One refers, with the term of work surface, to their surfaces in contact with the sheet 1.

The smooth work rolls will be present at least in the last stand of the rolling mill when the running direction of the sheet in the rolling mill is considered.

The use of smooth work rolls at least for the last rolling pass gives the possibility of better controlling the waviness $Wa_{0.8}$ of the steel sheet 1 obtained subsequently by coating of the sheet on the one hand and parts which may be produced by deforming the steel sheet 1 on the other hand.

In particular, such cold-rolling allows reduction in the waviness $Wa_{0.8}$ as compared with rolling only resorting to rolls with stronger roughness, etched either by shot-blasting, or by an electric discharge (so-called Electron Discharge Texture (EDT) rolls), for example In step C), the cold-rolled sheet 1 is annealed in a continuous annealing line. Preferably, the annealing is performed under a reducing atmosphere, aiming at recrystallization after the work hardening which it has undergone during the cold-rolling operation.

Recrystallization annealing further gives the possibility of activating the surfaces of the sheet to promote the chemical reactions required for the subsequent dip-coating operation.

Depending on the grade of the steel, the recrystallization annealing can be carried out at a temperature comprised between 65° and 1200° C., preferably between 65° and 900° C., for a period required for recrystallization of the steel and for activation of the surfaces.

The sheet is then cooled to a temperature close to that of a molten bath 2 contained in a crucible 3.

In step D), the steel sheet is coated by hot-dip coating in such bath 2. The composition of the bath 2 is based on zinc and contains from 0.8 to 1.4% by weight of aluminum, and from 0.8 to 1.4% by weight of magnesium. Preferably, the coating comprises from 1.0 to 1.40% by weight of Al and 1.0 to 1.40% by weight of Mg. Indeed, without willing to be bound by any theory, it is believed that these amounts of Al and Mg in the coating further improve the waviness of ZnAlMg coatings while keeping an improved corrosion resistance compared to Zn coatings.

The bath 2 may also contain up to 0.3% by weight of optional addition elements such as Si, Sb, Pb, Ti, Ca, Mn, Sn, La, Ce, Cr, Ni, Zr or Bi.

These different elements may allow improvement in the resistance to corrosion of the coating or else its brittleness or its adhesion, for example.

One skilled in the art who is aware of their effects on the characteristics of the coating will know how to use them according to the sought additional purpose. It was also checked that these elements did not interfere with controlling the waviness obtained by the method according to the invention.

Finally, the bath 2 may contain unavoidable impurities from ingots for feeding the tank or else further from the passage of the sheet 1 in the bath 2. Mention may thus be notably made of iron being for example up to 5 wt. % by weight.

During hot-dip coating, the aluminium present in the bath will first react with the steel to create a so-called inhibition layer composed of intermetallic elements made of aluminium and iron. Such inhibition layer is usually composed of $FeAl_3$ and has a thickness varying from 20 to 80 nm. The coating layer containing from 0.8 to 1.4% by weight of aluminum and from 0.8 to 1.4% by weight of magnesium, as described above, is formed on this inhibition layer.

Figure 2:
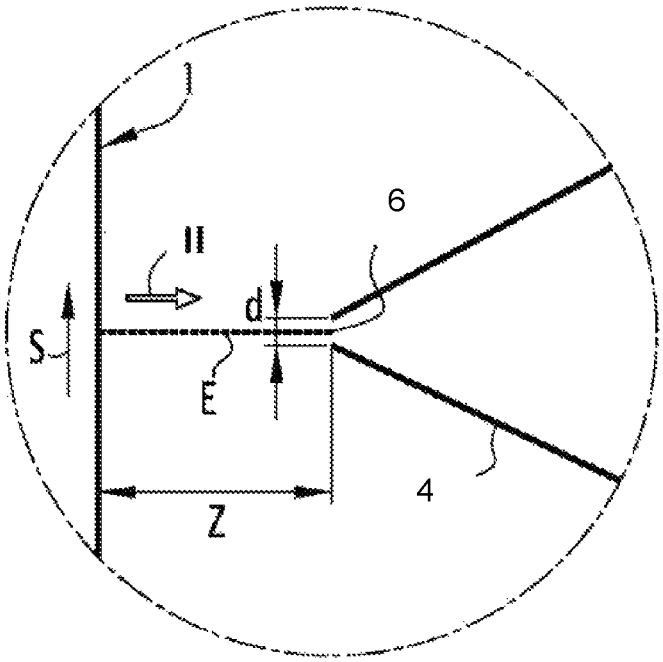

As illustrated by FIGS. 1 and 2, in step E), after exiting the bath 2, the steel sheet 1 runs into a confinement zone including wiping nozzles 4 placed on either side of the steel sheet 1 and which project a wiping gas, for example air or an inert gas, towards the outer surfaces of the coating. The confinement zone can, for example, be built according to WO 2010/130883 and be bounded:

at the bottom, by the wiping line (represented in dotted line on FIG. 2)

and the upper external faces of said wiping nozzles 4, at the top, by the upper part of two confinement boxes 5 placed on each side of the sheet, just above said nozzles 4, and having a height of at least 10 cm in relation to the wiping line and on the sides, by the lateral parts of said confinement boxes 5.

The wiping gas is ejected from each nozzle 4 along a main ejection direction E.

In the illustrated example, the directions E are horizontal and orthogonal to the steel sheet 1 and follow the wiping line. In other embodiments, the directions E may have other inclinations relatively to the steel sheet 1.

The running speed V of the sheet 1 on the production line used is generally comprised between 60 m/min and 200 m/min, and it is preferably between 80 m/min and 120 m/min.

Alternatively, the nozzle 4 may have different structures, different positions and/or operate with different adjustments. It is also possible to only provide a nozzle on one side of the steel sheet 1.

The nozzle 4 has an outlet 6 through which the wiping gas is ejected towards the outer surface of the coating placed opposite. Various outer shapes may be contemplated for the nozzle 4.

Figure 3:
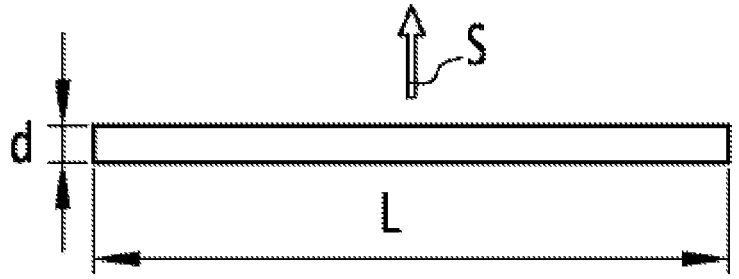
FIG. 3 is a schematic view taken along the arrow II of FIG. 2, and illustrating the shape of the output of the nozzle of FIG. 2.

The outlet 6 of the nozzle 4 is positioned at a distance Z from the steel sheet 1 along the main ejection direction E. As illustrated by FIG. 3, the outlet 6 generally appears as a slot which extends, perpendicularly to the running direction S and to the plane of FIG. 3, over a width L at least equal to the width of the steel sheet 1.

Preferably, the height of the outlet 6, i.e. its dimension parallel to the running direction S of the steel sheet 1 in front of the nozzle 4, is constant as illustrated by FIG. 3. This being the case, in certain alternatives, this height may vary over the width of the outlet 6. Thus, the outlet 6 may have for example a slightly flared shape towards its end (shape of a bowtie).

To take into account these possible height variations and the different possible embodiments, the average height d of the outlet 6 on its width L will be considered subsequently.

The nozzles 4 project a gas on each side of the steel sheet, said gas having preferably an oxidizing power lower than that of an atmosphere consisting of 4% oxygen by volume and 96% nitrogen by volume. In particular, it may be advantageous to use pure nitrogen or pure argon, or else mixtures of nitrogen or argon and oxidizing gases such as, for example, oxygen, CO/CO2 mixtures or H2/H2O mixtures. It is also possible to use CO/CO2 mixtures or H2/H2O mixtures without the addition of an inert gas. Preferably, the wiping gas consists of nitrogen.

Then, in step F), the coating is then left to cool in a controlled way so that it solidifies.

Further to this solidification step, it is possible to perform a step G) consisting in a skin-pass operation for giving texture to the outer surfaces 23 of the coating 7, facilitating subsequent forming process of the steel sheet 1.

Indeed, the skin-pass operation gives the possibility of transferring to the outer surfaces of the coating of the steel sheet 1 enough roughness in order for its forming process to be properly carried out, while promoting good retention of the oil applied on the steel sheet 1 before it is formed. The elongation rate of the steel sheet 1 during the skin-pass operation is generally comprised between 0.5 and 2%.

The skin-pass operation will give the possibility of keeping a low waviness $Wa_{0.8}$ since the work rolls have a work surface of which have a roughness below 5 μm.

The skin-pass operation will be preferably carried out with EDT work rolls for which the work surfaces have a roughness $Ra_{2.5}$ comprised between 1.70 and 2.95 μm. If the elongation rate during the skin-pass operation is less than or equal to 1.1%, the roughness $Ra_{2.5}$ of the work surfaces of the EDT work rolls will preferably be comprised between 2.50 and 2.95 μm. If the elongation rate during the skin-pass operation is greater than or equal to 1.1%, the roughness $Ra_{2.5}$ of the work surfaces of the EDT work rolls will preferably be comprised between 1.70 and 2.50 μm.

The skin-pass operation is generally carried out for a steel sheet 1 intended for manufacturing body parts for automobiles.

When the steel sheet 1 is intended for manufacturing domestic electric appliances, for example this additional operation is not carried out. In the case of parts for domestic electrical appliances, it is also possible to subject the paint films to a baking operation with physical and/or chemical means, known per se.

For this purpose, it is possible to have the painted part pass through a hot air or induction oven, or further under UV lamps or under a device diffusing electron beam.

With the method according to the present invention, it is possible to obtain a steel sheet with an outer surface having a waviness $Wa_{0.8}$ before skin-pass less than or equal to 0.50 μm and preferably less than or equal to 0.45 μm or even better less than or equal to 0.40 μm or less than or equal to 0.35 μm.

The steel sheet 1 having been skin-passed may then be cut out and then undergoes a forming process, for example by drawing, bending or profiling, to form a part which may then be painted to obtain, on each side a paint film (or a paint system).

After deformation, the outer surfaces of the part have a waviness $Wa_{0.8}$ of less than or equal to 0.50 μm, or even less than or equal to 0.45 μm or to 0.40 μm, or even to 0.38 μm.

This waviness may be measured after 5% equi-biaxial stretching using a Marciniak tool. In conventional methods, the waviness can be measured after 3.5% equi-biaxial stretching. A difference in waviness value of 0.03 is generally considered from 3.5 to 5% stretching.

For automotive applications, after phosphate-coating, each part is dipped in a cataphoresis bath, and a primer paint layer, a base paint layer, and optionally a finishing varnish layer are applied in succession.

Before applying the cataphoresis layer on the part, the latter is degreased beforehand and then phosphate-coated so as to ensure the adherence of the cataphoresis.

The cataphoresis layer provides the part with additional protection against corrosion. The primer paint layer, generally applied with a gun, prepares the final appearance of the part and protects it against stone chipping and against UVs. The base paint layer gives the part its color and its final appearance. The varnish layer imparts to the surface of the part, good mechanical strength, resistance against aggressive chemical agents and a good surface aspect.

Generally, the weight of the phosphate coating layer is comprised between 1.5 and 5 $g/m^2$.

The paint films applied for protecting and guaranteeing an optimum surface aspect to the parts, for example comprise a cataphoresis layer with a thickness from 15 to 25 μm, a coat of primer paint with a thickness from 35 to 45 μm, and a base coat of paint with a thickness from 40 to 50 μm.

In the cases when the paint films further comprise a varnish layer, the thicknesses of the different paint layers are generally the following:

cataphoresis layer: between 15 and 25 μm, preferably less than 20 μm, primer paint layer: less than 45 μm, base paint layer: less than 20 μm, and varnish layer: less than 55 μm.

Preferably, the total thickness of the paint films will be less than 120 μm or even 100 μm.

Finally, the object of the invention relates to a land motor vehicle comprising a body, the body comprising a part according to the present invention.

The invention will now be illustrated by tests given as an indication and not as a limitation.

Examples

For all samples, a conventional IF steel was cold-rolled, the last rolling pass being achieved with rectified and non-etched work rolls for which the work surfaces have a roughness $Ra_{2.5}$ of 0.35 μm. The samples were then annealed at a temperature of 765° C. and hot-dip coated with a molten bath comprising 1.2 wt. % of Al, 1.2 wt % of Mg (samples 2 to 38) or 1.5 wt. % of Al, 1.5 wt % of Mg (sample 1), the balance being Zn. They were then driven in a confinement zone and wiped with nitrogen. After the solidification of the coating, the coated steel sheet was skin-passed with rolls having a work surface have a roughness $Ra_{2.5}$ of 2.1 μm.

All samples were deformed using Marciniak tool. They were drawn in 5% equibiaxial stretching mode. Waviness before skin-pass (SKP), after skin-pass and after skin-pass and deformation (DEF) were measured for each sample.

The procedure for measuring the waviness $Wa_{0.8}$ is following the protocol according to the standard SEP1941 and consists in acquiring by mechanical probing (skidless) a steel sheet profile with a length of 50 mm, in the rolling direction. From the signal obtained by probing, the approximation of its general shape with a polynomial of a degree of 5 is subtracted. The waviness Wa and the arithmetic mean roughness Ra is then separated by a Gaussian filter by applying a cut-off of 0.8 mm. In the case of the steel sheet after deformation, the procedure is applied on deformed and undeformed zones of the sheet.

The process parameters and the waviness values of the Trials 1 to 15 were gathered in Table 1. Trials according to the invention all satisfy equation (1) or equation (2).

Additional trials 17 to 20, 22 to 25, 27, 28, 30 and 37 with improved waviness values were then performed and the corresponding process parameters and waviness values were gathered in Table 2. Such trials all satisfy equation (3) or equation (4), in addition to equation (1).

TABLE 1

| | Coating composition (wt. %) | | | Z | d | V | P | | Wiping | Eq | Eq | Eq | Eq | $Wa_{0.8}$ (μm) before | $Wa_{0.8}$ (μm) after | $Wa_{0.8}$ (μm) after DEF (5% |
|---|---|---|---|---|---|---|---|---|---|---|---|---|---|---|---|---|
| Trials | Zn | Al | Mg | (mm) | (mm) | (m/s) | (Pa) | pO2 | gas | (1) | (2) | (3) | (4) | SKP | SKP | deformation) |
| 1 | 97.0 | 1.5 | 1.5 | 9 | 1 | 1.5 | 3645 | 0.210 | Air | OK | | nOK | nOK | 1.01 | 0.47 | 0.96 |
| 2 | 97.6 | 1.2 | 1.2 | 8 | 1 | 1.3 | 12075 | 0.025 | $N_2$ | nOK | OK | nOK | nOK | 0.49 | 0.37 | 0.49 |
| 3 | 97.6 | 1.2 | 1.2 | 8 | 1 | 1.8 | 18620 | 0.023 | $N_2$ | OK | | nOK | nOK | 0.38 | 0.37 | 0.46 |
| 4 | 97.6 | 1.2 | 1.2 | 8 | 1 | 1.8 | 18375 | 0.023 | $N_2$ | OK | | nOK | nOK | 0.46 | 0.38 | 0.48 |
| 5 | 97.6 | 1.2 | 1.2 | 9 | 1 | 1.7 | 39782 | 0.015 | $N_2$ | OK | | nOK | nOK | 0.38 | 0.35 | 0.46 |
| 6 | 97.6 | 1.2 | 1.2 | 9 | 1 | 1.7 | 27234 | 0.040 | $N_2$ | OK | | nOK | nOK | 0.45 | 0.38 | 0.48 |
| 7 | 97.6 | 1.2 | 1.2 | 9.5 | 1 | 1.7 | 29395 | 0.060 | $N_2$ | nOK | OK | nOK | nOK | 0.48 | 0.38 | 0.49 |
| 8 | 97.6 | 1.2 | 1.2 | 9.5 | 1 | 1.7 | 38671 | 0.018 | $N_2$ | OK | | nOK | nOK | 0.43 | 0.37 | 0.47 |
| 9 | 97.6 | 1.2 | 1.2 | 9.5 | 1 | 1.8 | 48279 | 0.017 | $N_2$ | OK | | nOK | nOK | 0.43 | 0.37 | 0.47 |
| 10 | 97.6 | 1.2 | 1.2 | 10.2 | 1 | 1.8 | 47033 | 0.019 | $N_2$ | OK | | nOK | nOK | 0.47 | 0.37 | 0.49 |
| 11 | 97.6 | 1.2 | 1.2 | 10.2 | 1 | 1.7 | 42757 | 0.025 | $N_2$ | OK | | nOK | nOK | 0.48 | 0.37 | 0.49 |
| 12 | 97.6 | 1.2 | 1.2 | 10.2 | 1 | 1.5 | 33075 | 0.048 | $N_2$ | nOK | nOK | nOK | nOK | 0.55 | 0.38 | 0.52 |
| 13 | 97.6 | 1.2 | 1.2 | 11 | 1 | 1.7 | 47570 | 0.030 | $N_2$ | nOK | nOK | nOK | nOK | 0.53 | 0.38 | 0.51 |
| 14 | 97.6 | 1.2 | 1.2 | 11 | 1 | 1.7 | 36159 | 0.038 | $N_2$ | nOK | nOK | nOK | nOK | 0.60 | 0.38 | 0.54 |
| 15 | 97.6 | 1.2 | 1.2 | 11 | 1 | 1.3 | 5637 | 0.029 | $N_2$ | nOK | nOK | nOK | nOK | 0.53 | 0.38 | 0.52 |

Underlined values: not according to the invention

TABLE 2

| | Coating composition (wt. %) | | | Z | d | V | P | | Wiping | Eq | Eq | Eq | $Wa_{0.8}$ (μm) before | $Wa_{0.8}$ (μm) after | $Wa_{0.8}$ (μm) after DEF (5% |
|---|---|---|---|---|---|---|---|---|---|---|---|---|---|---|---|
| Trials | Zn | Al | Mg | (mm) | (mm) | (m/s) | (Pa) | pO2 | gas | (1) | (3) | (4) | SKP | SKP | deformation) |
| 16 | 97.6 | 1.2 | 1.2 | 7 | 1 | 1.3 | 6315 | 0.019 | $N_2$ | OK | OK | | 0.27 | 0.33 | 0.41 |
| 17 | 97.6 | 1.2 | 1.2 | 7 | 1 | 1.7 | 13438 | 0.023 | $N_2$ | OK | nOK | OK | 0.36 | 0.34 | 0.44 |
| 18 | 97.6 | 1.2 | 1.2 | 7 | 1.2 | 1.3 | 18596 | 0.020 | $N_2$ | OK | OK | | 0.20 | 0.32 | 0.38 |
| 19 | 97.6 | 1.2 | 1.2 | 7 | 1.2 | 1.7 | 11199 | 0.030 | $N_2$ | OK | OK | | 0.27 | 0.33 | 0.41 |
| 20 | 97.6 | 1.2 | 1.2 | 7.5 | 1 | 1.7 | 27693 | 0.019 | $N_2$ | OK | OK | | 0.31 | 0.33 | 0.42 |
| 21 | 97.6 | 1.2 | 1.2 | 7.5 | 1 | 1.7 | 4050 | 0.04 | $N_2$ | OK | nOK | OK | 0.35 | 0.33 | 0.43 |
| 22 | 97.6 | 1.2 | 1.2 | 7.5 | 1 | 1.3 | 24599 | 0.020 | $N_2$ | OK | OK | | 0.30 | 0.32 | 0.42 |
| 23 | 97.6 | 1.2 | 1.2 | 8 | 1 | 1.3 | 20097 | 0.06 | $N_2$ | OK | nOk | OK | 0.37 | 0.33 | 0.44 |
| 24 | 97.6 | 1.2 | 1.2 | 8 | 1 | 1.3 | 29400 | 0.016 | $N_2$ | OK | OK | | 0.38 | 0.34 | 0.43 |
| 25 | 97.6 | 1.2 | 1.2 | 8 | 1 | 1.7 | 38500 | 0.015 | $N_2$ | OK | OK | | 0.30 | 0.33 | 0.41 |
| 26 | 97.6 | 1.2 | 1.2 | 8 | 1 | 1.7 | 2514 | 0.018 | $N_2$ | OK | nOK | OK | 0.36 | 0.33 | 0.44 |

TABLE 2-continued

| Trials | Coating composition (wt. %) Zn | Al | Mg | Z (mm) | d (mm) | V (m/s) | P (Pa) | pO2 | Wiping gas | Eq (1) | Eq (3) | Eq (4) | $Wa_{0.8}$ (μm) before SKP | $Wa_{0.8}$ (μm) after SKP | $Wa_{0.8}$ (μm) after DEF (5% deformation) |
|---|---|---|---|---|---|---|---|---|---|---|---|---|---|---|---|
| 27 | 97.6 | 1.2 | 1.2 | 8 | 1 | 1.7 | 39500 | 0.015 | $N_2$ | OK | OK | | 0.28 | 0.33 | 0.43 |
| 28 | 97.6 | 1.2 | 1.2 | 8 | 1 | 1.8 | 25365 | 0.017 | $N_2$ | OK | nOK | OK | 0.37 | 0.33 | 0.44 |
| 29 | 97.6 | 1.2 | 1.2 | 8 | 1.2 | 1.3 | 6456 | 0.018 | $N_2$ | OK | OK | | 0.24 | 0.32 | 0.40 |
| 30 | 97.6 | 1.2 | 1.2 | 8 | 1.2 | 1.8 | 30877 | 0.016 | $N_2$ | OK | OK | | 0.25 | 0.33 | 0.41 |
| 31 | 97.6 | 1.2 | 1.2 | 8 | 1.2 | 1.8 | 14876 | 0.023 | $N_2$ | OK | nOK | OK | 0.32 | 0.33 | 0.43 |
| 32 | 97.6 | 1.2 | 1.2 | 8.5 | 1 | 1.3 | 26439 | 0.06 | $N_2$ | OK | nOK | OK | 0.37 | 0.33 | 0.44 |
| 33 | 97.6 | 1.2 | 1.2 | 8.5 | 1 | 1.7 | 33049 | 0.018 | $N_2$ | OK | nOK | OK | 0.36 | 0.33 | 0.44 |
| 34 | 97.6 | 1.2 | 1.2 | 8.5 | 1 | 1.8 | 36354 | 0.016 | $N_2$ | OK | nOk | OK | 0.35 | 0.34 | 0.43 |
| 35 | 97.6 | 1.2 | 1.2 | 9 | 1 | 1.8 | 43760 | 0.013 | $N_2$ | OK | nOK | OK | 0.36 | 0.33 | 0.44 |
| 36 | 97.6 | 1.2 | 1.2 | 9 | 1.2 | 1.8 | 36467 | 0.016 | $N_2$ | OK | OK | | 0.28 | 0.33 | 0.41 |
| 37 | 97.6 | 1.2 | 1.2 | 9 | 1.2 | 1.7 | 33751 | 0.019 | $N_2$ | OK | OK | | 0.29 | 0.33 | 0.42 |
| 38 | 97.6 | 1.2 | 1.2 | 9 | 1.2 | 1.7 | 6695 | 0.024 | $N_2$ | OK | OK | | 0.34 | 0.33 | 0.44 |

What is claimed is:

1. A method for manufacturing a steel sheet provided with a coating including from 0.80 to 1.40 wt. % of Al, from 0.80 to 1.40 wt. % of Mg, unavoidable impurities and optionally one or more additional elements selected from Si, Sb, Pb, Ti, Ca, Mn, Sn, La, Ce, Cr, Zr or Bi, the weight content of each additional element in the coating being less than 0.3%, a remainder being Zn, the method comprising the following successive steps:

A. providing the steel sheet,

B. cold rolling the steel sheet, at least a last rolling pass being achieved with rectified and non-etched work rolls for which the work surfaces have a roughness $Ra_{2.5}$ of less than or equal to 0.5 μm, C. annealing of the steel sheet in a continuous annealing line, D. depositing the coating by dipping the steel sheet in a molten bath, E. running the coated steel sheet through a confinement zone including wiping nozzles projecting a wiping gas, through at least one outlet, on each side of the sheet along a main ejection direction (E), so that a wiping satisfies at least one of the following equations:

$$\sqrt{\frac{V}{P}} \times \left(\frac{Z}{d}\right)^2 \leq 0.6566 \quad (1)$$

$$p_{O_2} \leq \left[\frac{200 \times \frac{V}{P}}{\ln\left[1.523 \times \sqrt{\frac{V}{P}} \times \left(\frac{Z}{d}\right)^2\right]}\right]^2 \quad (2)$$

wherein:

V is the running speed of the steel sheet in front of the nozzle, V being expressed in $m \cdot s^{-1}$, P is the pressure of the wiping gas in the nozzle, P being expressed in Pa, Z is the distance between the steel sheet and the nozzle along the main ejection direction (E), Z being expressed in mm, d is the average height of the outlet of the nozzle along the running direction(S) of the steel sheet in front of the nozzle, d being expressed in mm, $p_{O2}$ is the partial pressure in oxygen in the confinement zone;

F. solidifying the coating; and

G. skin-passing the coated steel sheet with work rolls having a roughness $Ra_{2.5}$ below 5 μm.

2. The method as recited in claim 1 wherein the skin-passing of the coated steel sheet is performed with EDT work rolls having a roughness $Ra_{2.5}$ from 1.70 to 2.95 μm.

3. The method as recited in claim 1 wherein at least one of the following equations is further satisfied:

$$\sqrt{\frac{V}{P}} \times \left(\frac{Z}{d}\right)^2 \leq 0.4887 \quad (3)$$

$$p_{O_2} \leq \left[\frac{200 \times \frac{V}{P}}{\ln\left[2.046 \times \sqrt{\frac{V}{P}} \times \left(\frac{Z}{d}\right)^2\right]}\right]^2. \quad (4)$$

4. The method as recited in claim 1 wherein the coating includes from 1.0 to 1.40% by weight of Al and 1.0 to 1.40% by weight of Mg.

5. The method as recited in claim 1 wherein the wiping gas consists of nitrogen.

* * * * *